US007797906B2

(12) United States Patent
Kassem

(10) Patent No.: US 7,797,906 B2
(45) Date of Patent: Sep. 21, 2010

(54) NON-PENETRATING ELASTOMERIC MEMBRANE ANCHORING SYSTEM

(75) Inventor: Gary Kassem, Sewickley, PA (US)

(73) Assignee: Single Source Roofing Corporation, Pittsburgh, PA (US)

( * ) Notice: Subject to any disclaimer, the term of this patent is extended or adjusted under 35 U.S.C. 154(b) by 76 days.

(21) Appl. No.: 11/975,853

(22) Filed: Oct. 22, 2007

(65) Prior Publication Data

US 2009/0100792 A1 Apr. 23, 2009

(51) Int. Cl.
*E04B 1/38* (2006.01)

(52) U.S. Cl. ..... 52/713; 52/710; 52/746.11

(58) Field of Classification Search ..... 52/63, 52/222, 656.7, 410, 710, 746.11, 745.21; 206/504, 509, 511; 220/345.1, 345.2, 345.4
See application file for complete search history.

(56) References Cited

U.S. PATENT DOCUMENTS 4,189,882 A * 2/1980 Harrison et al. ..... 52/222
4,193,235 A * 3/1980 Cucchiara ..... 52/202
4,453,585 A * 6/1984 Ruggeberg et al. ..... 160/354
4,519,175 A * 5/1985 Resan ..... 52/713
4,543,758 A * 10/1985 Lane ..... 52/410
4,586,301 A * 5/1986 Hickman ..... 52/96
4,617,771 A * 10/1986 Tomaszewski ..... 52/410
4,631,887 A * 12/1986 Francovitch ..... 52/410
4,658,558 A * 4/1987 Verble ..... 52/410
4,694,543 A * 9/1987 Conley ..... 24/461
4,731,960 A * 3/1988 Sease ..... 52/36.6
4,744,187 A * 5/1988 Tripp ..... 52/410
4,817,655 A * 4/1989 Brooks ..... 135/121
4,858,412 A * 8/1989 Kassem ..... 52/713
4,949,523 A * 8/1990 Kassem ..... 52/713
4,999,963 A * 3/1991 Verble ..... 52/410
5,209,029 A * 5/1993 Foerst ..... 52/63
5,224,306 A * 7/1993 Cramer ..... 52/63
5,237,785 A * 8/1993 Lukes ..... 52/86
5,647,176 A * 7/1997 Milliken et al. ..... 52/63
5,794,400 A * 8/1998 Fisher et al. ..... 52/844
6,758,014 B2 * 7/2004 Chen ..... 52/63
6,789,978 B1 * 9/2004 Yoshinari ..... 403/381
7,251,917 B2 * 8/2007 Cvek ..... 52/660
7,370,588 B2 * 5/2008 Franco ..... 108/90

* cited by examiner

*Primary Examiner*—David Dunn
*Assistant Examiner*—Joshua Ihezie
(74) *Attorney, Agent, or Firm*—David G. Oberdick

(57) ABSTRACT

An improved anchoring system for fastening an elastomeric membrane to a roof comprises an anchoring plate with a top planar surface, spaced apart, raised sidewalls over which the membrane may be laid and at least one aperture for securing to a roof. Each sidewall has a retaining lip that extends inwardly from the top planar surface for retaining a spacing insert, a top surface of which has raised flanges, each flange having a retaining lip with a plurality of longitudinally extending gripper ridges. Preferably, the retaining lips on the spacing insert extend over the top surface of the anchoring plate and taper toward one another at one or more areas between their end points. The system further includes a wedge for inserting into a cavity defined by the spacing insert.

16 Claims, 7 Drawing Sheets

NON-PENETRATING ELASTOMERIC MEMBRANE ANCHORING SYSTEM

FIELD OF THE INVENTION

This invention relates to an improved apparatus for attaching an elastomeric roofing membrane to a surface or a roof, and more particularly relates to an improved apparatus which is capable of securing a membrane to a roof or other surface without penetrating or damaging the membrane.

BACKGROUND OF THE INVENTION

The traditional method used to protect roofs or other surfaces from rain and other forms of inclement weather was to lay down several layers of material, normally felt soaked material with bitumen, thereby building up a waterproof membrane. This method has several problems. The first problem is that the process is very long, and is also susceptible to contamination by rainwater or other foreign materials. Secondly, the bitumen must be heated to the point where it gives off noxious odors.

In recent years, alternate systems using elastomeric membranes have become increasingly popular. In these methods, a suitable elastomeric membrane is laid over the top surface of the roof itself or, more preferably, an insulation board. A variety of methods for fastening the elastomeric membrane to the surface of the roof have been developed. One method is to spread an adhesive over the entire surface of the roof before laying down the membrane. This process is very labor-intensive and requires the installers to be exposed to adhesives that give off noxious fumes.

Alternatively, the membrane can be fastened to the roof mechanically. Several devices have been developed which require that a nail or screw be allowed to penetrate the membrane. This can lead to rips and tears in the membrane, especially as the membrane expands and contracts in response to changes in the ambient temperature. These breaches in the integrity of the membrane, in turn, can lead to water leakage and eventual damage to the underlying roof.

Other methods, patented by the applicant herein (U.S. Pat. Nos. 4,858,412 and 4,949,523), disclose a system of attaching the membrane to a roof without penetrating the membrane with a nail or screw or using adhesives that give off noxious fumes.

This invention represents an improvement over both of the above-cited patents, particularly with respect to occasionally observed variations in the equalization of the membrane shrinkage, membrane bunching and/or improper stretching encountered with the prior systems. The features of the present invention, such as but not limited to, the gripper ridges and tapered lips, will help eliminate prior disadvantages like these.

SUMMARY OF THE INVENTION

Accordingly, it is among the objects of the present invention to remedy the foregoing disadvantages of the related systems by providing an improved, non-penetrating anchoring system with a device that supplies the majority of locking force necessary to keep the system interlocked and the elastomeric roofing membrane stable.

The present invention further provides a non-penetrating anchoring system which can be serviced easily and without damaging the device used to interlock same or the elastomeric membrane. The present system additionally prevents over- or under-tightening.

A further object of the present invention is to provide a non-penetrating anchoring system which can accommodate a variety of different types of elastomeric membranes as well as the factory seams formed where multiple sheets of elastomeric membrane are joined in the factory to form a larger panel. Yet another object provides an economical system for attaching an elastomeric roofing membrane to an existing structure without the use of special tools or extensive modification of the existing structure.

The present invention includes a fastening method for attaching a membrane anchoring system to the roof.

Importantly, the present invention also comprises gripper ridges on the spacing insert for equalization of membrane shrinkage and improved wind resistance. Preferred embodiments include tapered lips on the spacing insert for greater resistance to damage caused by wind and vibrations. The anchoring plate would have rounded edges to minimize sharp corners which may cut the membrane if not assembled correctly.

Specifically, what is provided is an improved anchoring system for fastening an elastomeric membrane to a roof comprises: an anchoring plate with a top planar surface; spaced apart, raised sidewalls over which the membrane may be laid; and at least one aperture for securing to a roof. Each sidewall has a retaining lip that extends inwardly from the top planar surface for retaining a spacing insert, a top surface of which has raised flanges, each flange having a retaining lip with a plurality of longitudinally extending gripper ridges. Preferably, the retaining lips on the spacing insert extend over the top surface of the anchoring plate and taper toward one another at one or more areas between their end points. The system further includes a wedge for inserting into a cavity defined by the spacing insert.

These and other objects and advantages will become more apparent from the following detailed description taken in conjunction with the illustrative FIGURES, and the novel features thereof will be defined in the appended claims.

BRIEF DESCRIPTION OF THE DRAWINGS

FIG. 20 is a perspective view of the spacing insert for seams in a fully attached anchoring system showing the sealing tape, caulk or the like.

DESCRIPTION OF THE PREFERRED EMBODIMENTS

Figures 1, 2:
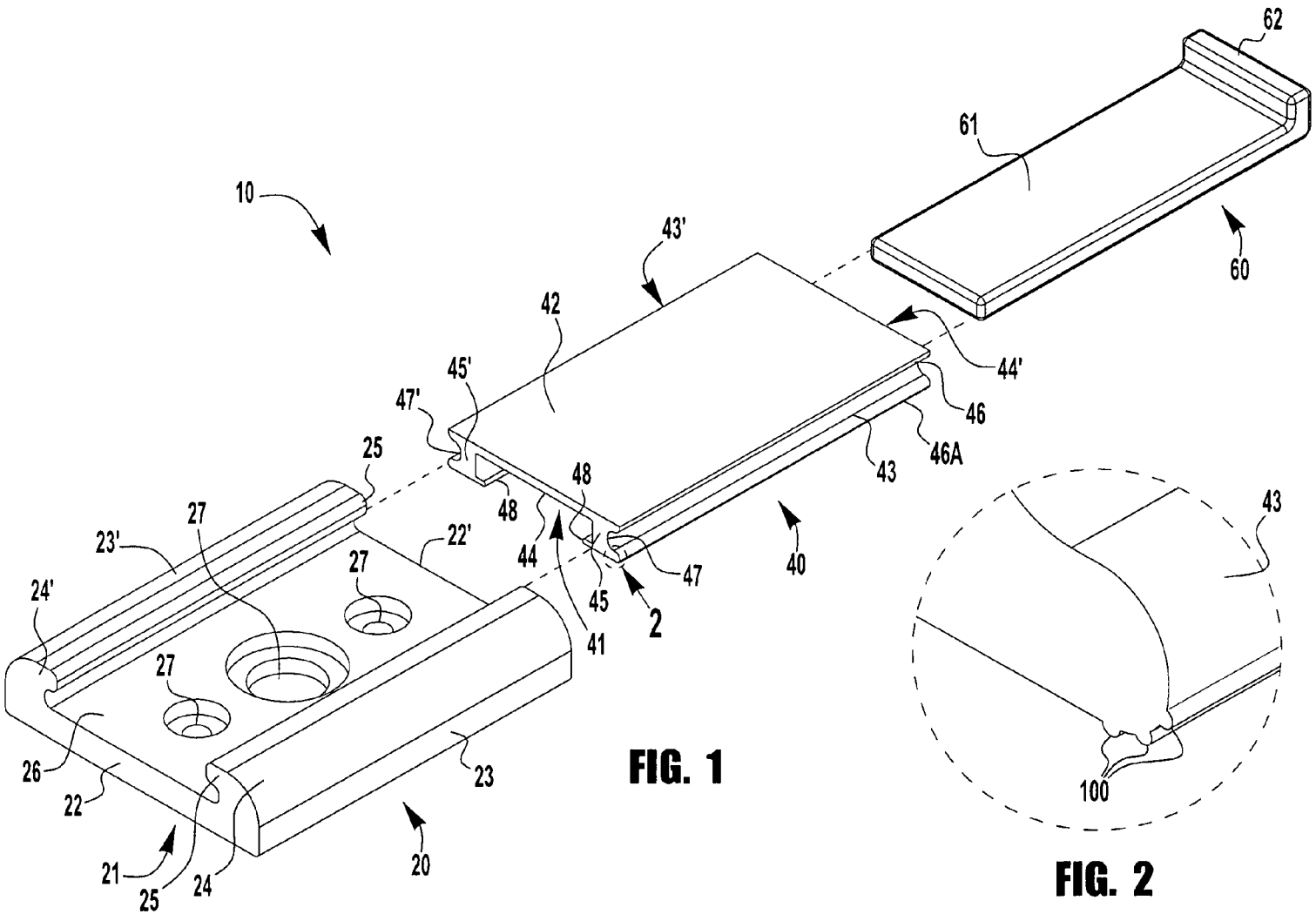
FIG. 1 is an exploded view of the present invention showing the relative positioning of the anchoring plate, spacing insert and insert wedge.
FIG. 2 is a blown up view of the spacing insert of FIG. 1 showing the gripper ridges on one embodiment of the present invention.

As used herein, the term "substantially parallel" means of two or more lines, or three-dimensional planes, which do not intersect, or contact one another. In a broader sense, components which are substantially parallel shall be substantially equidistant, or spaced about the same distance apart in multiple lines and/or planes.

The invention will now be described in detail in relation to multiple preferred embodiments and implementations thereof which are exemplary in nature and descriptively specific as disclosed. As is customary, it will be understood that no limitation of the scope of the invention is thereby intended. The invention encompasses such alterations and further modifications in the illustrated apparatus and method, and such further applications of the principles of the invention illustrated herein, as would normally occur to persons skilled in the art to which the invention relates.

Referring now to FIGS. 1-28 wherein like numbers refer to like elements throughout, the anchoring system 10 includes, in general, an anchoring plate 20, a spacing insert 40 or 40', an insert wedge 60 and a fastening means. The anchoring plate 20 is rigid and, as best shown in FIGS. 1, 8, 9 and 12, includes a planar bottom 21 with optional cutouts 150 into said planar bottom for reducing the total weight and cost of the device. It is to be understood that the geometry (i.e. shape), location, and number of these cutouts may vary. See FIG. 9 for a representative elongated, rectangle configuration for two cutouts 150. The anchoring plate 20 is generally polygonal, preferably rectangular or square in shape, having two shorter sides 22 and 22' and two longer sides 23 and 23'. Two inwardly curved sidewalls 24 and 24' are disposed along the two longer sides 23 and 23' and extend perpendicularly to the top planer surface 26 of the anchoring plate 20. The anchoring plate 10 can optionally be any other shape that would be adaptable to the spacing insert 40 or 40' and insert wedge 60.

Figure 10:
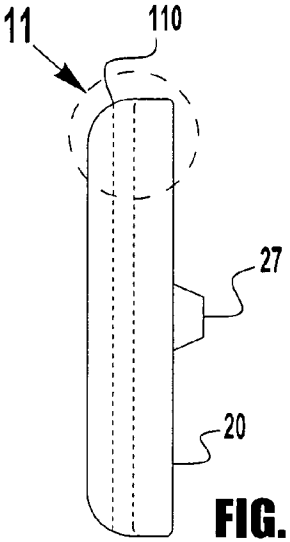
FIG. 10 is a side view of a preferred embodiment of the anchoring plate of the present invention.
Figure 11:
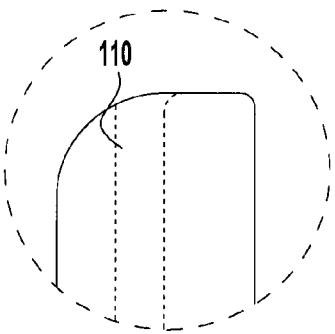
FIG. 11 is a blown up view of FIG. 10 showing the rounded edge of the anchoring plate of the present invention, which prevents membrane degradation and tearing or damage due to mechanical impact.
Figure 8:
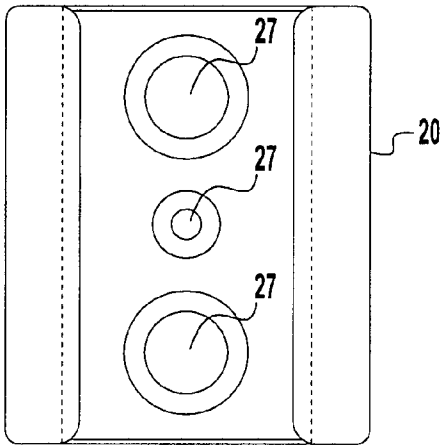
FIG. 8 is a top view of one embodiment of anchoring plate of the present invention showing the plurality of apertures for attachment to a roof or other surface.
Figure 9:
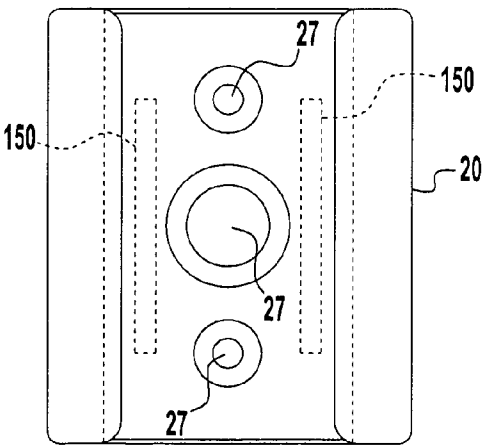
FIG. 9 is a top view of an alternative embodiment of anchoring plate of the present invention showing a pair of representative shapes cut out from the bottom or underside of said anchoring plate.

The two inwardly curved sidewalls 24 and 24' each have a horizontal lip 25 which extends inwardly over the top planar surface 26 of the anchoring plate 20. Further, as shown in FIGS. 1, 10 and 11, the two inwardly curved sidewalls 24 and 24' have rounded edges 110 on their topmost portions to prevent the elastomeric membrane 90 from ripping, degrading or tearing during use.

Preferred embodiments of the anchoring plate 20 can be seen in FIGS. 1, 8, 9 and 12. The anchoring plate 20 is provided with a plurality of apertures 27 to facilitate securing the anchoring plate 20 to the top surface of a roof or other surface, for example and not by limitation, by an elongated screw 71, peel rivet 75 or other fastening means known to those skilled in the art. Such apertures can vary in size and shape (See FIGS. 1, 8 and 9) or, alternatively, be similarly sized (See FIG. 12).

As shown in FIGS. 5, 7, 13 and 14, the apertures 27 are preferably counter-bored to allow the elongated screw 71, peel rivet 75 or other fastening means to be tightened down to the point where the head of the screw or rivet is beneath the top planar surface 26 of the anchoring plate 20. Such counter-boring assures that the elastomeric membrane 90 is not abraded by the heads of the elongated screws 71, peel rivets 75 or other fastening means.

Figure 23:
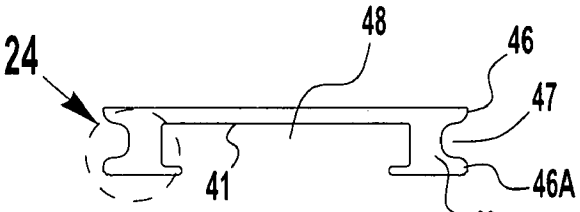
FIG. 23 is a front view of a second embodiment of the spacing insert of the present invention.
Figure 24:
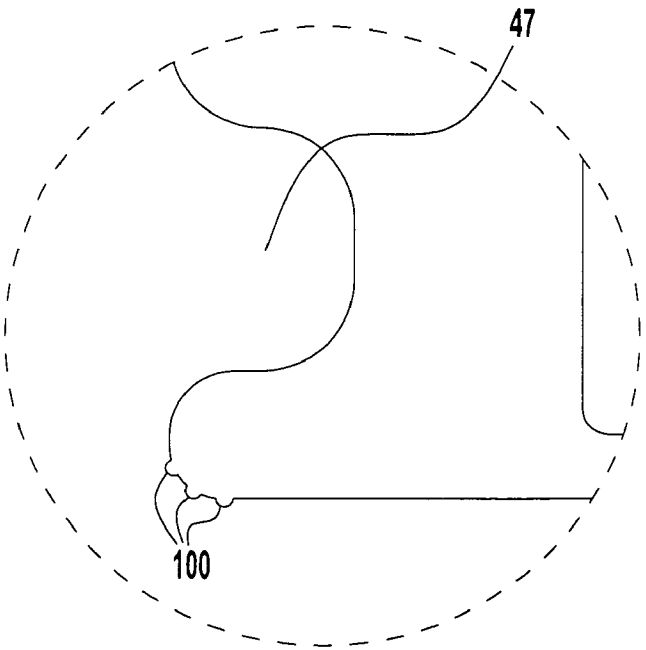
FIG. 24 is a blown up view of FIG. 23 showing the gripper ridges of the present invention.
Figure 21:
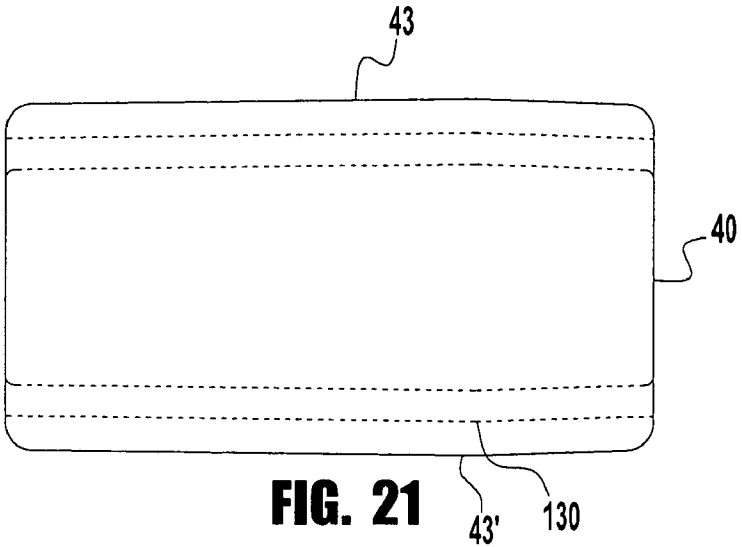
FIG. 21 is a top view of the spacing insert showing one alternative embodiment of lip tapering at a point about ¼ the length of both spacing insert sides.
Figure 22:
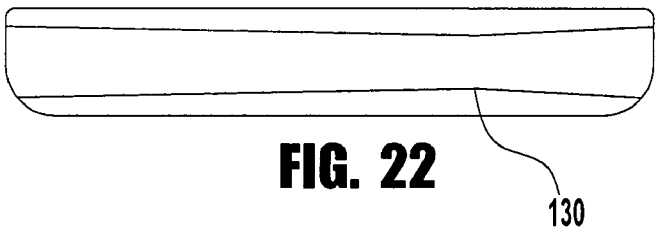
FIG. 22 is a side view of the spacing insert showing the first preferred lip taper of FIG. 21.
Figure 25:
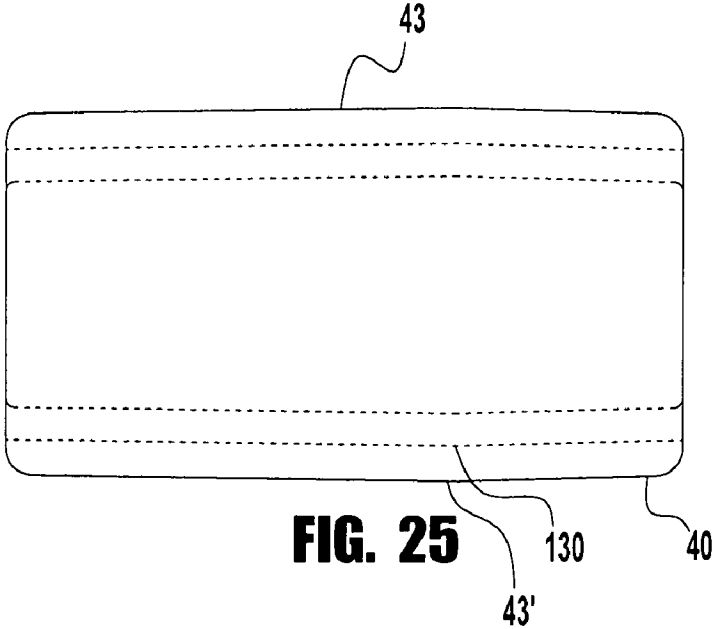
FIG. 25 is a top view of the spacing insert showing a second alternative embodiment of lip tapering at a point about ⅓ the length of both spacing insert sides.
Figure 26:
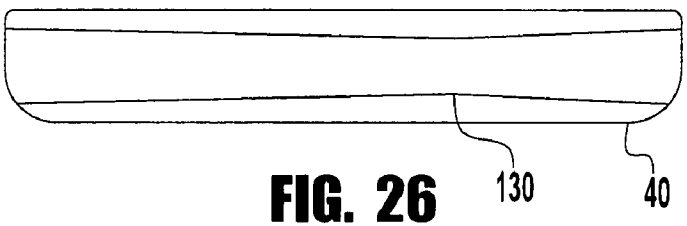
FIG. 26 is a side view of the spacing insert showing the preferred lip taper of FIG. 25.
Figure 27:
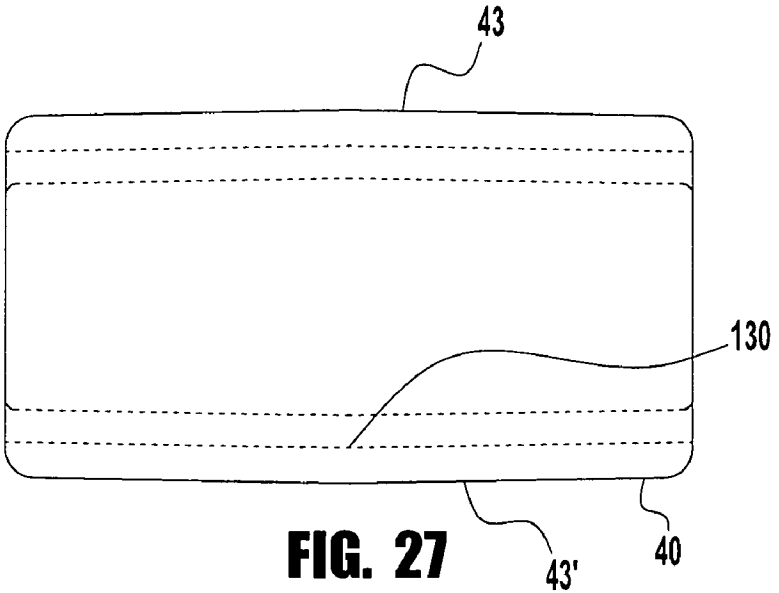
FIG. 27 is a top view of the spacing insert showing a third alternative embodiment of lip tapering at or near the midpoint of the long sides of the spacing insert.
Figure 28:
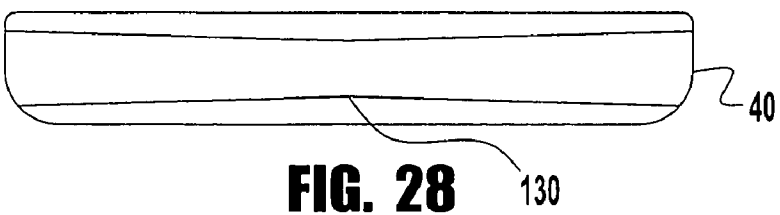
FIG. 28 is a side view of the spacing insert showing the lip taper of FIG. 27.

The second component of the anchoring system 10 of the present invention is a spacing insert 40 (See e.g., FIGS. 1 and 23). The spacing insert 40 has a planar bottom 41 and top surface 42. Like the anchoring plate 20, the spacing insert 40 is generally polygonal, preferably rectangular or square in shape, but can be any other shape or size that can interlock with the anchoring plate 20. This spacing insert 40 preferably has two longer sides 43 and 43' and two shorter sides 44 and 44'. A pair of vertical flanges 45 and 45' are disposed parallel to the longer sides 43 and 43' and perpendicular to top surface 42 of the spacing insert 40. These flanges 45 and 45' are positioned near the outer edges of the spacing insert 40.

Each of the flanges 45 and 45' has a top lip 46 extending outwardly therefrom. Also included is a bottom lip **46*a* that extends both inwardly and outwardly from each flange 45 and 45'. The top lip 46 is parallel to, and on the same plane as, the planar top surface 42 of spacing insert 40. The bottom lip 46*a* is also parallel to the planer top surface 42 of the spacing insert 40 but is located on a plane beneath the bottom planer surface 41**.

The outer portion of each lip 46 and 46*a* extends beyond the edge of the two longer sides 43 and 43' of the spacing insert 40, and when considered in conjunction with the exterior face of the flanges 45 and 45', forms a C-shaped notch 47 and 47' (See FIGS. 1, 3, 23 and 24).

The bottom lip 46*a* of the spacing insert 40 further comprises gripper ridges 100 (See e.g., FIGS. 2, 4, 6, 18, 23 and 24). The gripper ridges 100 are disposed on the circumference of the outer end of the bottom lip 46*a*, furthest from the midpoint for spacing insert 40. Preferably, such gripper ridges extend longitudinally along the whole width of each spacing insert. The gripper ridges 100 help collect the elastomeric membrane 90 during installation and assist in equalizing shrinkage by allowing the elastomeric membrane 90 to release slowly and recover from the stretching that occurs when the anchoring system 10 of the present invention is used. The equalization of the elastomeric membrane's stress prevents excessive loading at the fastening points and increases the anchoring system's overall performance during wind storms.

The top lip 46 and bottom lip 46*a* preferably taper toward each other to a point on each lip (46 or 46*a*) along the length of longer sides 43 and 43' (See FIGS. 21, 22, 25, 26, 27 and 28). Such intentional tapering changes the relative width of notch 47 between said top lip 46 and bottom lip 46*a*. Both top lip 46 and bottom lip 46*a* taper in a direction perpendicular to the longitudinal axis of each respective lip 46 and 46*a*. The bottom lip 46*a* tapers away from the bottom planar surface 41 of the spacing insert 40, while the top lip tapers toward the bottom planer surface 41 of the spacing insert 40. The width of the lips 46 and 46*a* can vary depending upon the embodiment and size of the invention, with the width at the respective endpoints preferably less than the width of the lips 46 and 46*a* at their thickest portions. This lip tapering 130 can be seen in a plurality of preferred embodiments at FIGS. 21, 22, 25, 26, 27 and 28. As noted in the referenced FIGURES, the thickest portion of the lips 46 and 46*a* can optionally be disposed at various points along the longer sides 43 and 43': at a point roughly about ¼ to about ⅓ the length of both longer sides 43 and 43' (per FIGS. 21/22 and 25/26, respectively); or at or near the midpoint of these longer sides 43 and 43' (per FIGS. 27/28). This lip tapering 130 is meant to prevent the spacing insert 40 from sliding and disengaging due to vibration. It further provides for improved wind resistance.

The portion of the bottom lip 46*a* which extends inwardly from the flanges 45 and 45', when taken in conjunction with the portion of the planar bottom surface 41, disposed between the two flanges 45 and 45', forms a substantially rectangular-shaped cavity 48 into which the insert wedge 60 is inserted. There, it will conform to the configuration of the flanges 45 and 45' of the spacing insert 40 and thereby provide sufficient rigidity to the anchoring system 10. By this method of attachment, the anchoring system 10 securely fastens an elastomeric membrane 90 to a top surface or a roof. The cavity 48 formed in the spacing insert 40 can optionally be any other shape which is adaptable for the insert wedge 60.

A factory seam in the membrane 90 usually results in the seam area being about twice as thick of the rest as the normal elastomeric membrane 90. The anchoring system 10 of the present invention provides a solution to the increased elastomeric membrane 90 thickness at a factory seam. For fastening along a factory seam (or when using a thick membrane), factory seam spacing inserts 40' (See FIGS. 18-20) without a top lip 46 are preferably used. This allows the spacing insert 40' to accommodate the additional elastomeric membrane 90 thickness. Anchoring system 10 will not function properly without using a spacing insert like 40 or 40'.

Figure 3:
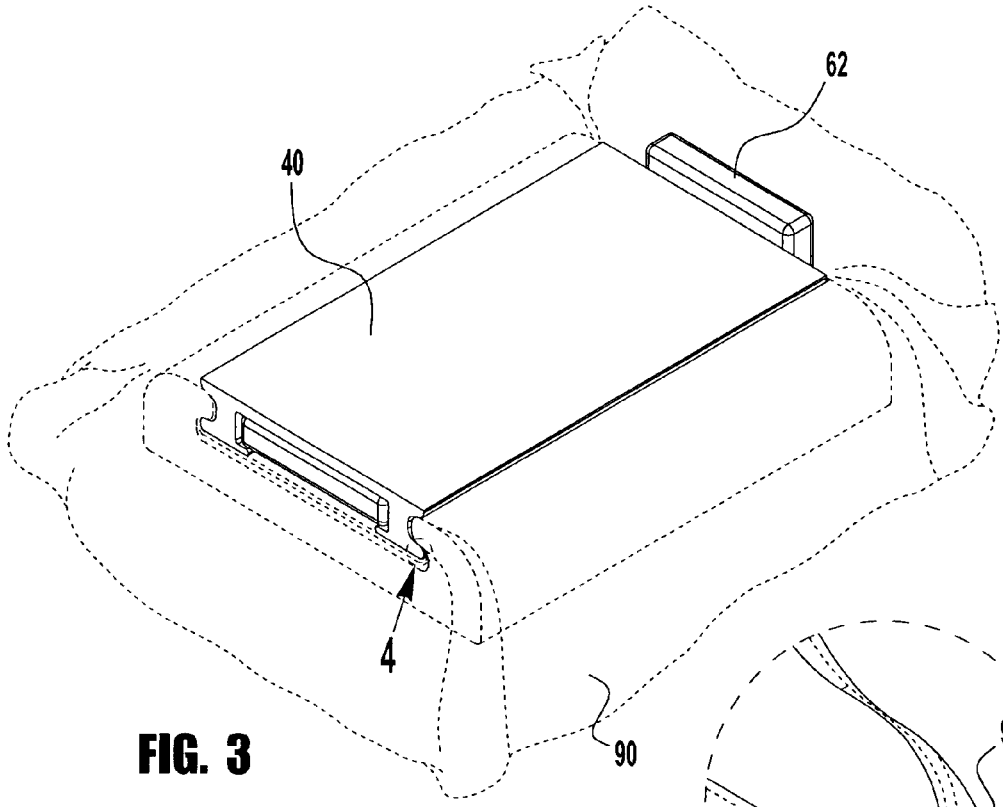
FIG. 3 is a perspective view showing the constituent components of the present invention assembled, and in the process of securing an elastomeric membrane.
Figure 20:
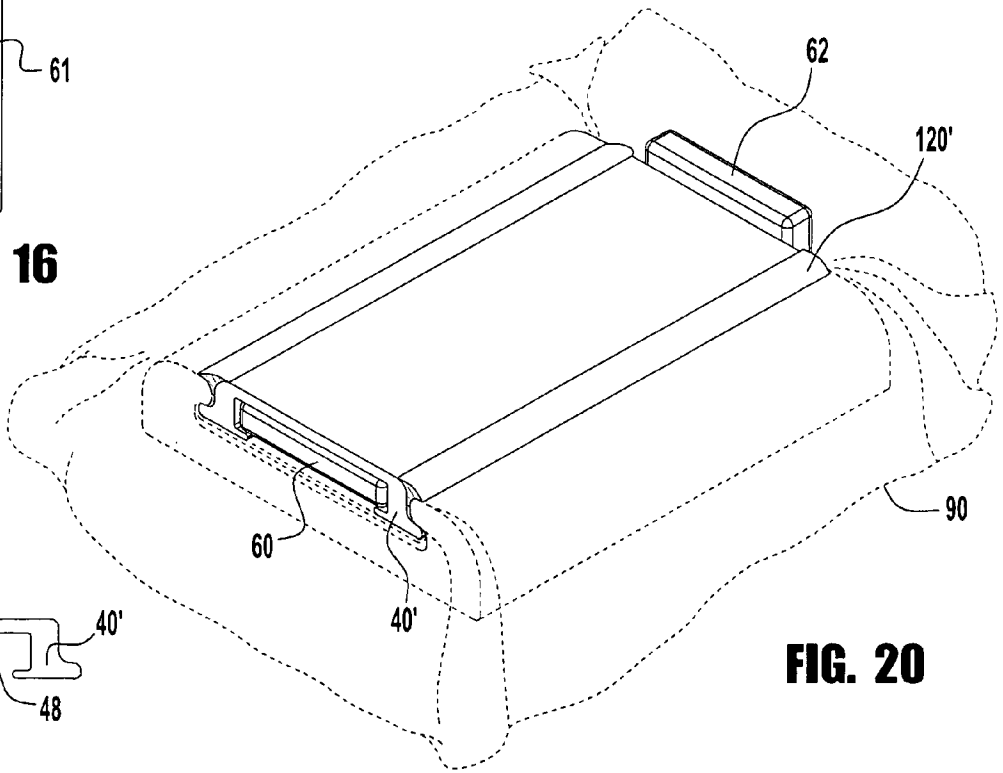
Figure 16:
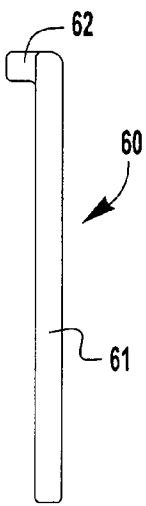
FIG. 16 is a side view of a preferred embodiment of the insert wedge of the present invention.
Figure 15:
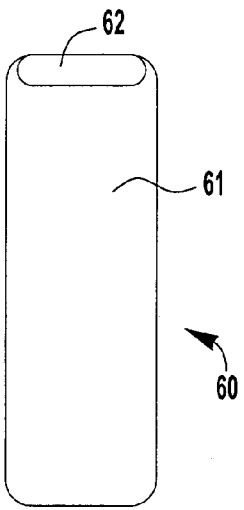
FIG. 15 is a top view of a preferred embodiment of the insert wedge of the present invention.
Figure 17:
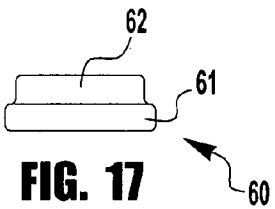
FIG. 17 is a front view of a preferred embodiment of the insert wedge of the present invention.
Figure 18:
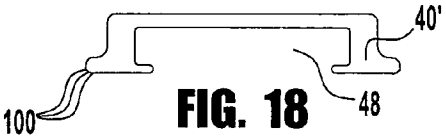
FIG. 18 is a front view of a preferred embodiment of the spacing insert of the present invention.

The third major component of the present anchoring system 10 is an insert wedge 60. The insert wedge 60, like the spacing insert 40 and anchoring plate 20, is preferably formed of substantially rigid plastic, but can also optionally be formed of any other material. The insert wedge 60 has a planar member 61, which can be inserted within the substantially rectangular-shaped or other shaped cavity 48 of the spacing insert 40. Further, the insert wedge 60 has a lip 62 disposed preferably perpendicular to the horizontal plane of the planar member 61. This lip 62 prevents the spacing insert 40 from being inserted completely through the cavity 48. The spacing insert lip 62 additionally provides a means for easily removing the spacing insert 40 from the rectangular cavity 48 upon disassembly. As shown in FIGS. 1, 3 and 20, in particular, lip 62 faces upward.

Figure 5:
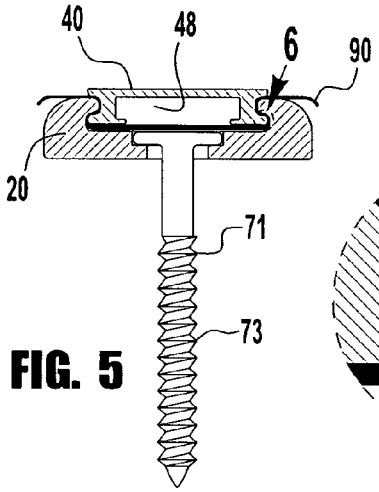
FIG. 5 is a side view of a preferred embodiment of the anchoring plate, spacing insert and elongated screw fully inserted.
Figure 6:
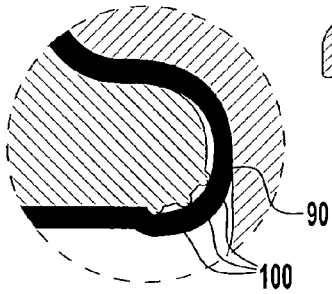
FIG. 6 is a blown up view of FIG. 5 showing the gripper ridges of the present invention interacting with the elastomeric membrane to equalize shrinkage in the membrane.
Figure 7:
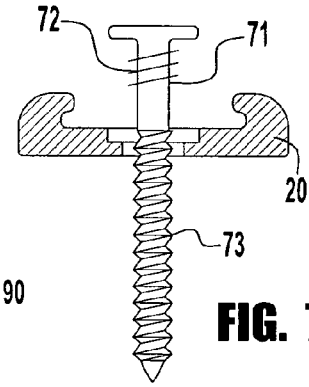
FIG. 7 is a side view of the anchoring plate with another preferred elongated screw partially inserted.
Figure 12:
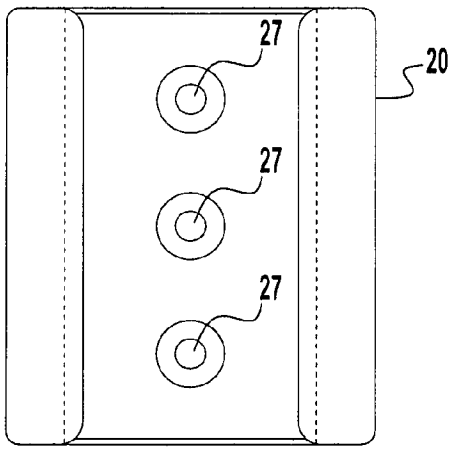
FIG. 12 is a top view of another preferred embodiment of the anchoring plate of the present invention showing the plurality of apertures for attachment to a roof or other surface.
Figure 14:
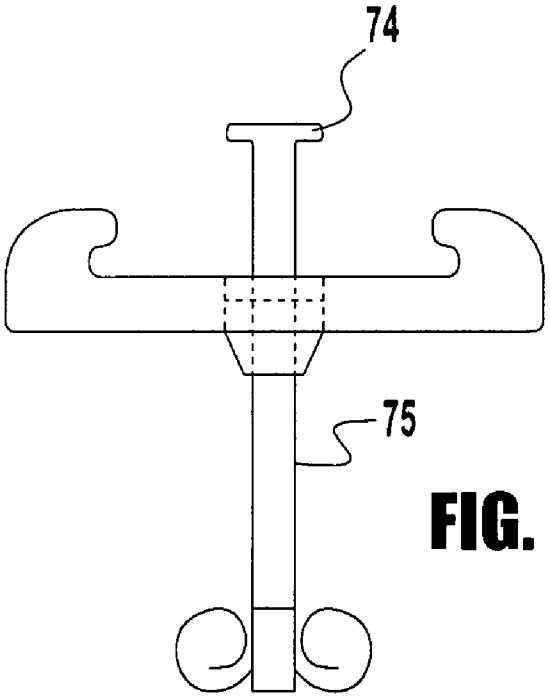
FIG. 14 is a side view of an anchoring plate of the present invention with a preferred fastening means partially inserted.
Figure 13:
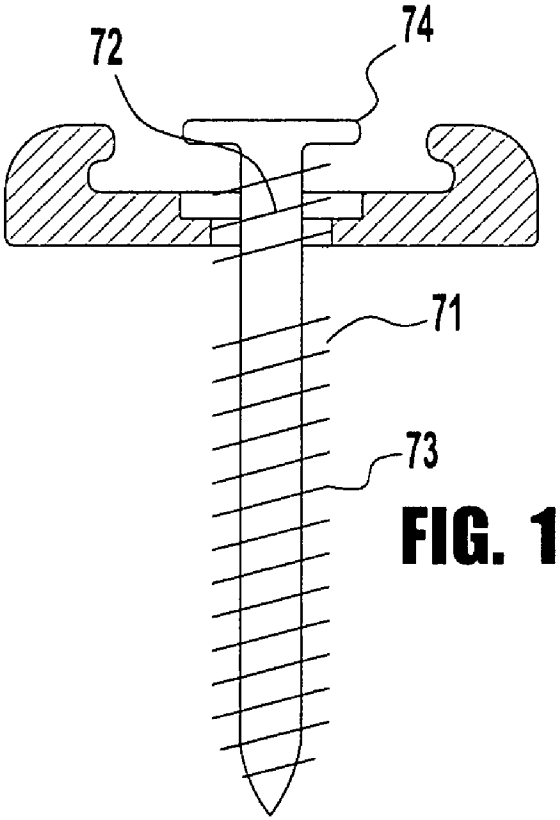
FIG. 13 is a side view of an anchoring plate of the present invention with a preferred elongated screw partially inserted.

Finally, the anchoring system 10 utilizes appropriate fastening means, of preferably the elongated screw 71 in FIGS. 5, 7, 13, or the peel rivet 75 in FIG. 14, to secure the anchoring plate 20 to a roof surface. Any other type of fastening means known to those skilled in the art can also optionally be used. In the elongated screw 71 embodiment, the elongated screw 71 has upper threads 72 and lower threads 73 on its upper and lower ends, respectively. The lower threads 73 hold the anchoring plate 20 to the roof or other surface while the screw head 74 and upper threads 72 anchor the elongated screw 71 to the anchoring plate 20. In the peel rivet embodiment, said peel rivet 75 is inserted like the elongated screw 71 and peels to anchor the anchoring plate 20 to the roof deck or structural substrate. In this embodiment, the screw head 74 holds the peel rivet 75 to the anchoring plate 20.

Any driving mechanism known in the art, including but not limited to a hand or power tool and/or rivet gun, can be used to insert the peel rivet 75 or elongated screw 71 into the plurality of apertures 27 of the anchoring plate 20. The elongated screw 71 or peel rivet 75 is preferably inserted completely until screw head 74 is in the countersunk aperture 27. Optionally, conventional screws, nails or other means of attachment can also be used instead of the special fasteners described above.

Operation

After the upper surface of a roof is prepared for installation and prior to installing the roof membrane, the first step in assembling and utilizing the anchoring system 10 of the present invention is to fasten the anchoring plate 20 to the roof deck or structural substrate. As is shown in FIGS. 5, 7, 13 and 14, this can be done by inserting elongated screws 71 and/or peel rivets 75 through the apertures 27 in the top planer surface 26 of the anchoring plate 20. It is preferred that the elongated screw 71 be fully tightened down, or peel rivet 75 fully inserted, in order that the elastomeric membrane 90 not be abraded by the screw head 74. As is best seen in FIGS. 1, 5, 7, 13 and 14, the plurality of apertures 27 are formed in such a way that the screw head 74 can preferably be counter-bored beneath the top surface of the anchoring plate 20.

The next step in utilizing the anchoring system 10 of the present invention is to spread the elastomeric membrane 90 over the upper surface of the roof or other surface. Then, a plurality of anchoring plates 20 are secured to the roof or other surface by securely inserting the elongated screws 71 or peel rivets 75 into the plurality of apertures 27. As will be more fully discussed below, the thickness of the elastomeric membrane 90 at those places where it overlays the anchoring plate 20 preferably determines which spacing insert 40 or 40' is used.

For example, at the calendar seams formed where adjacent rolls of elastomeric membrane 90 are joined together, the effective thickness of the membrane 90 is about twice as great as in places where anchoring plates 20 have been positioned beneath the middle of a sheet of the elastomeric membrane 90. Furthermore, in some situations especially high-wear installations, it may be desirable to utilize a heavier-than-normal elastomeric membrane 90. For example, a 60 mil 0.060" membrane could be used instead of the normal 45 mil 0.045" membrane. Therefore, at these membrane seams and/or when a heavier membrane 90 is used, the installer preferably uses the spacing insert for seams 40' (See FIGS. 18 and 19), instead of the spacing insert 40, to accommodate the additional thickness of the membrane 90.

Figure 19:
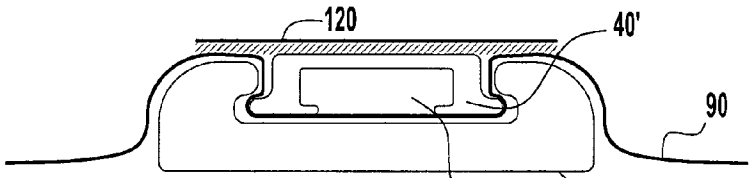
FIG. 19 is a front view of the spacing insert for seams, installed into the anchoring plate, having a sealing tape, caulk or the like sealing means for sealing the gap between the spacing insert and the anchoring plate.

When the seam spacing insert 40' is used, a gap is created where the top lip 46 is normally disposed. As a UV shield, a cover tape, caulking 120 or other material which protects the elastomeric membrane 90 is used to fill the gap (See FIGS. 19 and 20). In FIG. 19, cover strip 120 is applied across and adhered, by tape or other adhesive, to the width of spacing insert 40'; and in FIG. 20, caulking 120' is applied along just both longer sides of spacing insert 40'. Such shielding prevents the degradation of the elastomeric membrane 90, which naturally occurs due to the stress on the membrane 90, from wrapping around the anchoring plate 20.

Figure 4:
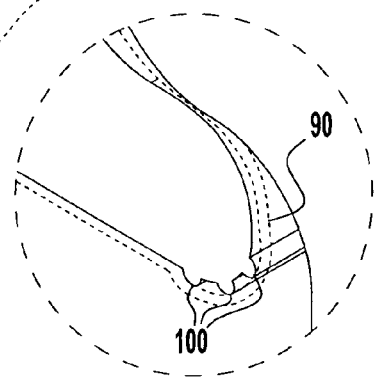
FIG. 4 is a blown up view of the spacing insert of FIG. 3 showing the gripper ridges of the present invention interacting with the elastomeric membrane to equalize shrinkage in the membrane.

Once the spacing insert 40 has been slid or pushed into place, as is shown in FIG. 4, the horizontal lips 25 of the anchoring plate 20 are secured within the C-shaped notches 47 formed as part of the spacing insert 40 by the portion of the top and bottom lips 46 and 46*a* extending outwardly from the flanges 45 and 45', taken in conjunction with the outer face of the flanges 45 and 45', in a tongue-and-groove fashion. That renders such parts capable of reliably securing and immobilizing the elastomeric membrane 90 within the anchoring plate 20.

When the spacing insert 40 or 40' is fully engaged into the anchoring plate 20, the gripper ridges 100 interact with the elastomeric membrane 90 to equalize shrinkage in the membrane 90. This equalization is provided by allowing the membrane to release slowly and recover from the stretching caused by sliding or placing the spacing insert 40 or 40' into the anchoring plate 20.

In any preferred embodiment, the final step in utilizing the anchoring system 10 of the present invention is to insert the insert wedge 60 within the substantially rectangular-shaped cavity 48 of the spacing insert 40 or 40' and thereby interlock the components of the anchoring system 10 in a secure fashion. The insert wedge 60 is inserted into the substantially rectangular-shaped cavity 48 in such a way that the planar bottom member 61 of the insert wedge 60 becomes positioned between the flanges 45 and 45' and the bottom planar surface 41 of the spacing insert 40 or 40' as shown in FIGS. 3 and 20. It should be noted that insert wedge 60 is preferably installed into insert 40 or 40' facing up as in FIGS. 1 and 3. If inserted with lip 62 facing downward, insert wedge 60 and lip 62 may pinch and/or damage the membrane 90, and insert wedge 60 will be difficult to remove.

The insertion of the insert wedge 60 within the substantially rectangular-shaped cavity 48 of the spacing insert 40 or 40' is facilitated by the spacing insert lip 62 situated perpendicularly to the planer bottom member 61. The spacing insert lip 62 is inserted by hand into the rectangular-shaped cavity 48 of the spacing insert 40 or 40'.

The process of disassembling the present anchoring system 10, as may become desirable in order to inspect or repair the elastomeric membrane 90, is similarly easy to accomplish and is begun by using a mallet or other tool to drive the insert wedge 60 out of the rectangular-shaped cavity 48 of the spacing insert 40, preferably by contacting the insert wedge lip 62.

The foregoing description of the preferred embodiment of the present invention is to be considered as illustrative only. Furthermore, since numerous modifications and variations will readily occur to those skilled in the relevant art, it is not desired to limit the scope of the present invention to the exact construction and operation shown and described and, accordingly, all suitable modifications and equivalents which fall within the scope of the claims may be resorted to.

I claim:

1. In an anchoring system for fastening an elastomeric membrane to a roof, said system including:

(a) an anchoring plate having a top planar surface and a pair of spaced apart, raised sidewalls each with an outside edge over which the membrane may be laid, each sidewall having a retaining lip that extends inwardly from, and substantially parallel to, said top planar surface for the retention of a spacing insert, and at least one aperture in said top planar surface for securing said anchoring plate to said roof;

(b) a spacing insert with outer edges arranged for inserting into said anchoring plate; a planar bottom of said spacing insert having a pair of vertical flanges that divide said planar bottom into an interior region between said flanges, and two exterior regions, each flange having an upper retaining lip that extends over said retaining lip of the anchoring plate when assembled, the inwardly extending portions of said lips, interior faces of said flanges and the interior region of said planar bottom defining a cavity into which an insert wedge may be slid for securely interlocking said anchoring system and outwardly extending portions of said lips, exterior faces of said flanges, an upper retaining lip, and a lower retaining lip defining a pair of C-shaped notches that snappingly engage the retaining lips of said anchoring plate after said membrane has been laid thereover;

(c) the insert wedge having a top and a bottom surface and a raised lip along one edge that facilitates insertion of said insert wedge in said spacing insert cavity; and (d) means for securely fastening said anchoring plate to said roof, wherein each retaining lip on the spacing insert includes a plurality of longitudinally extending gripper ridges which allow the elastomeric membrane to release and recover from the stretching caused by sliding or placing insert into the anchor plate.

2. The improvement of claim 1, wherein the outside edges of the raised sidewalls to the anchoring plate are curved for reducing cutting or tearing of the membrane.

3. The improvement of claim 1, wherein said retaining lips on the spacing insert do not extend substantially parallel to the top surface of the anchoring plate along the length of said anchoring plate.

4. The anchoring system for fastening an elastomeric membrane to a roof according to claim 3,
wherein said retaining lips on the spacing insert taper towards each other along the length of said anchoring plate.

5. The improvement of claim 4, wherein said retaining lips on the spacing insert taper towards each other near a midpoint of said anchoring plate.

6. The improvement of claim 4, wherein the widths of said retaining lips at their respective endpoints are less than the widths of said lips at their thickest portions.

7. In an anchoring system for fastening an elastomeric membrane to a roof, said system including:

(a) an anchoring plate having a top planar surface and a pair of spaced apart, raised sidewalls each with an outside edge over which the membrane may be laid, each sidewall having a retaining lip that extends inwardly from and substantially parallel to said top planar surface for the retention of a spacing insert, and at least one aperture in said top planar surface for securing said anchoring plate to said roof;

(b) a spacing insert with outer edges arranged for inserting into said anchoring plate; a planar bottom of said spacing insert having a pair of vertical flanges that divide said planar bottom into an interior region between said flanges, and two exterior regions, each flange having an upper retaining lip that extends over said retaining lip of the anchoring plate when assembled, the inwardly extending portions of said lips, interior faces of said flanges and the interior region of said planar bottom defining a cavity into which an insert wedge may be slid for securely interlocking said anchoring system and outwardly extending portions of said lips, exterior faces of said flanges, an upper retaining lip, and a lower retaining lip defining a pair of C-shaped notches that snappingly engage the retaining lips of said anchoring plate after said membrane has been laid thereover;

(c) the insert wedge having a top and a bottom surface and a raised lip along one edge that facilitates insertion of said insert wedge in said spacing insert cavity; and (d) means for securely fastening said anchoring plate to said roof, wherein the retaining lips on the spacing insert taper towards each other along the length of said anchoring plate.

8. The improvement of claim 7, wherein said retaining lips on the spacing insert taper towards each other near a midpoint of said anchoring plate.

9. The improvement of claim 7, wherein the widths of said retaining lips at their respective endpoints are less than the widths of said lips at their thickest portions.

10. An anchoring system for fastening an elastomeric membrane to a roof, said system comprising:

(a) an anchoring plate having a top planar surface and a pair of spaced-apart, raised sidewalls each with an outside edge over which the membrane may be laid, each sidewall having a retaining lip that extends inwardly from and substantially parallel to said top planar surface for the retention of a spacing insert, and at least one aperture in said top planar surface for securing said anchoring plate to said roof;

(b) a spacing insert with outer edges arranged for inserting into said anchoring plate; a planar bottom of said spacing insert having a pair of vertical flanges that divide said planar bottom into an interior region between said flanges, and two exterior regions, each flange having an upper and a lower retaining lip, the lower retaining lips including a plurality of longitudinally extending gripper ridges which allow the elastomeric membrane to release and recover from the stretching caused by sliding or placing insert into the anchor plate, said upper retaining lips on the spacing insert extending over but not substantially parallel to, the length of the retaining lips of said anchoring plate, the inwardly extending portions of said lips, interior faces of said flanges and the interior region of said planar bottom defining a cavity into which an insert wedge may be slid for securely interlocking said anchoring system and outwardly extending portions of said lips, exterior faces of said flanges, the upper retaining lip, and the lower retaining lip defining a pair of C-shaped notches that snappingly engage the retaining lips of said anchoring plate after said membrane has been laid thereover;

(c) the insert wedge having the top and a bottom surface and a raised lip along one edge that facilitates insertion of said wedge in said spacing insert cavity; and (d) means for securely fastening said anchoring plate to said roof.

11. An anchoring system for fastening an elastomeric membrane to a roof, said system comprising:

(a) an anchoring plate having a top planar surface and a pair of spaced-apart, raised sidewalls each with an outside edge over which the membrane may be laid, each sidewall having a retaining lip that extends inwardly from and substantially parallel to said top planar surface for the retention of a spacing insert, and at least one aperture in said top planar surface for securing said anchoring plate to said roof;

(b) a spacing insert with outer edges arranged for inserting into said anchoring plate; a planar bottom of said spacing insert having a pair of vertical flanges that divide said planar bottom into an interior region between said flanges, and two exterior regions, the inwardly extending portions of said lips, interior faces of said flanges and the interior region of said planar bottom defining a cavity into which an insert wedge may be slid for securely interlocking said anchoring system and outwardly extending portions of said lips, exterior faces of said flanges, an upper retaining lip, and a lower retaining lip defining a pair of C-shaped notches that snappingly engage the retaining lips of said anchoring plate after said membrane has been laid thereover;

(c) the insert wedge having a top and a bottom surface and a raised lip along one edge that facilitates insertion of said wedge in said spacing insert cavity; and (d) means for securely fastening said anchoring plate to said roof, wherein the retaining lips on the spacing insert taper towards each other along the length of said anchoring plate.

12. The anchoring system of claim 11, wherein said retaining lips on the spacing insert taper towards each other near a midpoint of said anchoring plate.

13. The anchoring system of claim 11, wherein the widths of said retaining lips at their respective endpoints are less than the widths of said lips at their thickest portions.

14. The improvement of claim 4, wherein said retaining lips on the spacing insert taper towards each other nearer one end said anchoring plate.

15. The improvement of claim 7, wherein said retaining lips on the spacing insert taper towards each other nearer one end said anchoring plate.

16. The anchoring system of claim 11, wherein said retaining lips on the spacing insert taper towards each other nearer one end said anchoring plate.

* * * * *